US010232403B1

(12) United States Patent
Daranuta

(10) Patent No.: US 10,232,403 B1
(45) Date of Patent: Mar. 19, 2019

(54) SPREADING TOOL HAVING A VARIABLE WIDTH AND VARIABLE DEPTH BLADE

(71) Applicant: Vitalie Daranuta, Destin, FL (US)

(72) Inventor: Vitalie Daranuta, Destin, FL (US)

( * ) Notice: Subject to any disclaimer, the term of this patent is extended or adjusted under 35 U.S.C. 154(b) by 303 days.

(21) Appl. No.: 15/182,703

(22) Filed: Jun. 15, 2016

(51) Int. Cl.
*B05C 17/10* (2006.01)
*E04F 21/16* (2006.01)
*E04F 21/24* (2006.01)

(52) U.S. Cl.
CPC ..... *B05C 17/10* (2013.01); *E04F 21/161* (2013.01); *E04F 21/241* (2013.01)

(58) Field of Classification Search
CPC ..... B05C 17/10; E04F 21/0084; E04F 21/16; E04F 21/161; E04F 21/162; E04F 21/163; E04F 21/165; E04F 21/1652; E04F 21/24; E04F 21/241; E04F 21/32
USPC ..... 15/235.4, 235.6, 235.8, 236.01, 236.95, 15/236.06, 236.08, 236.09, 245, 245.1; 30/169, 172; 425/458
See application file for complete search history.

(56) References Cited

U.S. PATENT DOCUMENTS 338,029 A 3/1886 Bright
471,115 A 3/1892 Hawksley
629,851 A * 8/1899 Glen ..... 15/245
674,117 A 5/1901 Lefebvre
697,902 A 4/1902 Tripp
1,091,370 A 3/1914 Menke
1,541,964 A * 6/1925 Harries ..... E04F 21/165 15/105.5
1,591,840 A 7/1926 Kelly
1,594,775 A 8/1926 Greslen
1,731,186 A 10/1929 Young
1,789,636 A * 1/1931 Oberti ..... A47L 13/11 15/245
2,094,703 A 10/1937 Hitzman
2,179,563 A 11/1939 Sassano
2,329,438 A 9/1943 Fiedler, Jr.
2,385,149 A 9/1945 Martines
2,526,401 A 10/1950 Oscar
2,759,218 A 8/1956 Smith
2,902,713 A 9/1959 Buelow
2,984,857 A 5/1961 Ames
3,343,202 A 9/1967 Ames
(Continued)

FOREIGN PATENT DOCUMENTS

FR 2881449 * 8/2006
JP 2012-197633 * 10/2012

*Primary Examiner* — Mark Spisich
(74) *Attorney, Agent, or Firm* — Peter Loffler

(57) ABSTRACT

A spreading tool has blade for which the width and depth deployment of the blade are each variable. A pair of plates sandwich the blade between them and allow the blade to slide up and down therebetween in order to vary depth deployment. The blade is formed from two plates that each has a blade edge, the two plates slide with respect to each other, varying the overlap of the two blade edges and thus blade width. Slots on each plate with a connector passing therethrough, hold the blade plates together. Aligned slot pairs on the sandwiching plates receive a connector to hold the blade in its sandwiched position, each connector slides within its slot pair and abuts one of the sides of the blade to hold the blade in its selected width. Additional connectors connect the main plate and press plate without passing through the blade.

6 Claims, 6 Drawing Sheets

(56) References Cited

U.S. PATENT DOCUMENTS

| | | | | |
|---|---|---|---|---|
| 4,229,032 | A | 10/1980 | Murphy | |
| 4,516,868 | A | 5/1985 | Molnar | |
| 4,654,919 | A | 4/1987 | Liberman | |
| 4,678,365 | A | 7/1987 | Ban et al. | |
| 4,766,635 | A | 8/1988 | Devitis | |
| 4,804,321 | A * | 2/1989 | Riesgo | E04F 21/22 118/413 |
| 4,915,610 | A | 4/1990 | Curry | |
| 5,143,264 | A | 9/1992 | MacMillan | |
| 5,160,748 | A | 11/1992 | Gauuan | |
| 5,807,022 | A | 9/1998 | McCleary | |
| 5,809,608 | A * | 9/1998 | Zadro | B41F 15/44 15/245 |
| 6,018,924 | A | 2/2000 | Tamlyn | |
| 6,053,659 | A * | 4/2000 | Burton | E01C 19/187 15/235.8 |
| 6,183,237 | B1 | 2/2001 | Blanchard et al. | |
| 6,308,370 | B1 * | 10/2001 | Southby | E04F 21/20 15/235.6 |
| 6,379,080 | B1 | 4/2002 | Saffo, Sr. | |
| 6,606,758 | B1 | 8/2003 | Fridman | |
| 7,070,667 | B1 | 7/2006 | Kirby | |
| 7,318,716 | B2 | 1/2008 | Castagnetta, Jr. | |
| 7,357,597 | B2 | 4/2008 | Face, III et al. | |
| 7,493,671 | B2 | 2/2009 | Hurley et al. | |
| 7,930,991 | B2 | 4/2011 | Northrup et al. | |
| 8,393,824 | B2 | 3/2013 | Schroeder et al. | |
| 8,973,206 | B1 | 3/2015 | Vivonetto | |
| 9,011,040 | B1 | 4/2015 | Canepa | |

* cited by examiner

SPREADING TOOL HAVING A VARIABLE WIDTH AND VARIABLE DEPTH BLADE

BACKGROUND OF THE INVENTION

1. Field of the Invention

The present invention relates to a tool for spreading an appropriate adhesive, such as mastic, wherein the width of the spreading tool blade as well as the depth of deployment of the blade are each independently adjustable.

2. Background of the Prior Art

Often, when installing tile, especially wall tile although sometimes with floor tile, a customer desires to have a relatively thin accent stripe of a different tile located between sections of the main tile being installed in order to achieve a desired look of the overall tile installation. Typically, the installer lays the main tile on either side of the location whereat the accent stripe is to be placed first, and once the main tile is laid, the installer lays the accent strip within the gap between the main tile sections to complete the job.

Accent stripe installation presents twin concerns for the tile installer. First, the gap between the two sections of main tile laid initially depends on the width of the accent stripe to be installed, which widths vary by tile as well as by the thickness of the desired grout line between the accent tile and the main tile. This presents a problem for the installer as the installer needs to spread an appropriate tile adhesive, such as mastic, in an even, uniform thickness so that the accent tiles adhere properly and their surface is flush with that of the main tile. However, the installer may have one or a couple of spreading tools with standard width blades. If the width of the blades available to the installer do not match the width of the gap, the installer is forced to use a spreading tool that has a blade that is narrower than the gap width and make two passes during the spreading of the adhesive within the gap, partially filling the gap with a first section of the adhesive during a first pass through the gap with the spreading tool, the width of this section being equal to the width of the blade of the spreading tool. Thereafter, installer fills the remainder of the gap with the adhesive with a second pass through the gap with the spreading tool. The problem occurs during the second pass due to the fact that the spreading tool blade must also pass along a portion of the adhesive spread during the first gap pass which causes some of the adhesive being spreading during the second pass of the spreading tool through the gap to be pushed onto the first section of the adhesive, especially where the blade of the spreading tool overlaps the first section of adhesive. This results in a centrally disposed bugle or otherwise uneven spreading of the adhesive within the gap. When the accent tile is placed into gap, the tile is adhered mainly to the bugle either with little to no adherence to the non-bugles portions or a tilt to one side or the other with the bulge acting as a fulcrum. In either instance a poor install of the accent tile is achieved.

The other concern of the installer lays in the fact that often the main tile and the accent tile are of two different thicknesses. As the installer desires to have the visible surface of the main tile and the accent tile be flush, the installer accounts for this thickness difference by adjusting the thickness of the adhesive laid within the gap. If the accent tile is thinner relative to the main tile, then the thickness of the adhesive is thicker within the gap relative to the adhesive thickness for the main tile, and vice versa. The problem is that adjusting the thickness to the desired level is no easy task and many installers simply eyeball the thickness and hope for the best in the final install. If the installer guesses correctly, no problem, however, if the installer does not guess correctly, then a poor install occurs.

To address these problems, spreading tools that have the ability to vary either the width of the blade or the depth of deployment of the blade have been proposed. While sometimes effective, such tools tend to be complex in design and construction so as to be relatively expensive to produce. Additionally, such tools tend to be difficult to adjust properly for a given job, resulting in lost installation time and frustration.

Accordingly, there is a need in the art for a spreading tool for spreading adhesives and other spreadable material, which tool addresses the above described problems in the art. Specifically, such a tool must allow the width of spreading blade as well as the depth of deployment of the spreading blade to each be adjustable. Such a tool must be simple in design to and construction and be easy to deploy for a variety of jobs.

SUMMARY OF THE INVENTION

The spreading tool having a variable width and variable depth blade of the present invention addresses the aforementioned needs in the art by providing a spreading tool that can spread adhesives and similar items with the blade of the tool being variable in its width. Additionally, the depth of deployment of the blade is separately variable. The spreading tool having a variable width and variable depth blade is of simple design and construction, being produced using standard manufacturing techniques, so as to make the device relatively inexpensive to produce, making the device economically attractive to potential consumers for this type of product. The spreading tool having a variable width and variable depth blade is to simple to deploy so that variation of either blade width or blade depth deployment is simple and easy, allowing the installer to focus on the actual installation job at hand. The spreading tool having a variable width and variable depth blade allows the use of a blade that has two different blade ends, such as smooth and notched. Switching between the two blade ends is fast and easy.

The spreading tool having a variable width and variable depth blade of the present invention is comprised of a main plate that has a first bottom edge, a top edge and a first pair of slots that are each parallel with the first bottom edge. A press plate has a second bottom edge and a second pair of slots that are each parallel with the second bottom edge. A blade has a first side edge, a second side edge, and an overall blade edge that has a length that is variable. The blade is placed onto the main plate and the press plate is positioned onto the blade so that the blade is securely sandwiched between the main plate and the press plate. The overall blade edge is disposed below the first bottom edge of the main plate a selected distance and the blade is also disposed below the second bottom edge of the press plate. Each of the first slots is aligned with a respective one of the second slots and a first connector passes through one of the aligned first slot second slot pairs and a second connector passes through the other aligned first slot second slot pair when the press plate is secured to the main plate in order to hold the blade sandwiched between and in a fixed relation with the main plate and the press plate. The first connector abuts the first side of the blade and the second connector abuts the second side of the blade. The blade is comprised of a first blade plate that has a first blade edge and a first outer side and a second blade plate that has a second blade edge and a second outer side. The first blade plate and the second blade plate are disposed in overlapping position with one another so that the first blade edge and the second blade edge align on an axis in order to form the overall blade edge. The first blade plate and second blade plate slide with respect to each other in order to vary a distance to between the first outer side and the second outer side and thereby vary the length of the overall blade edge. The first outer side forms the first side edge and the second outer side forms the second side edge. The first blade plate has a third slot and the second blade plate has a fourth slot. The third slot and the fourth slot partially overlap (the amount of overlap varies with blade length variation) and a third connector passes through the third slot and the fourth slot and is capable of sliding within the third slot and the fourth slot. Ruler markings are located along the second bottom edge of the press plate. A handle is attached to the top edge of the main plate. A third connector connects the main plate and the press plate and does not pass through the blade.

BRIEF DESCRIPTION OF THE DRAWINGS

Similar reference numerals refer to similar parts throughout the several views of the drawings.

DESCRIPTION OF THE PREFERRED EMBODIMENT

Figure 1:
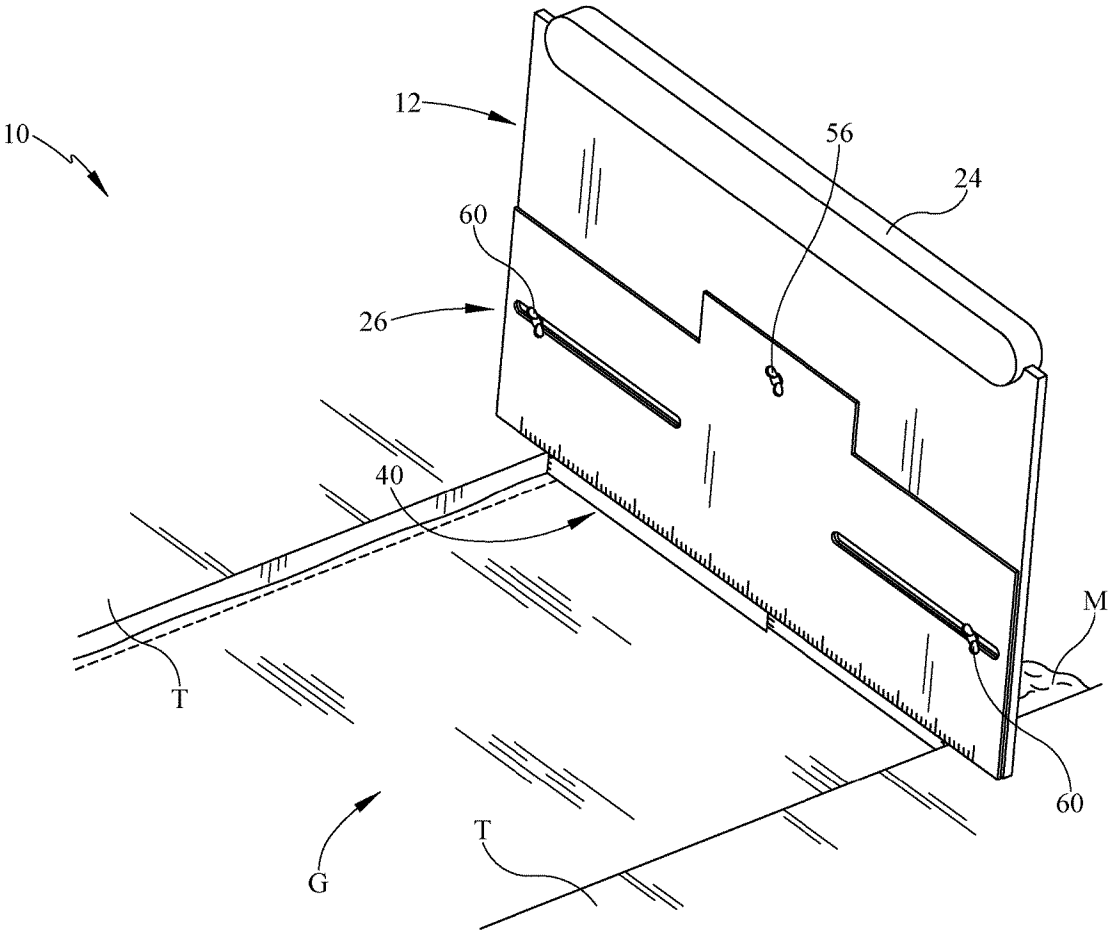
FIG. 1 is an environmental view of the spreading tool having a variable width and variable depth blade of the present invention spreading an adhesive within a relatively wide gap.
Figure 2:
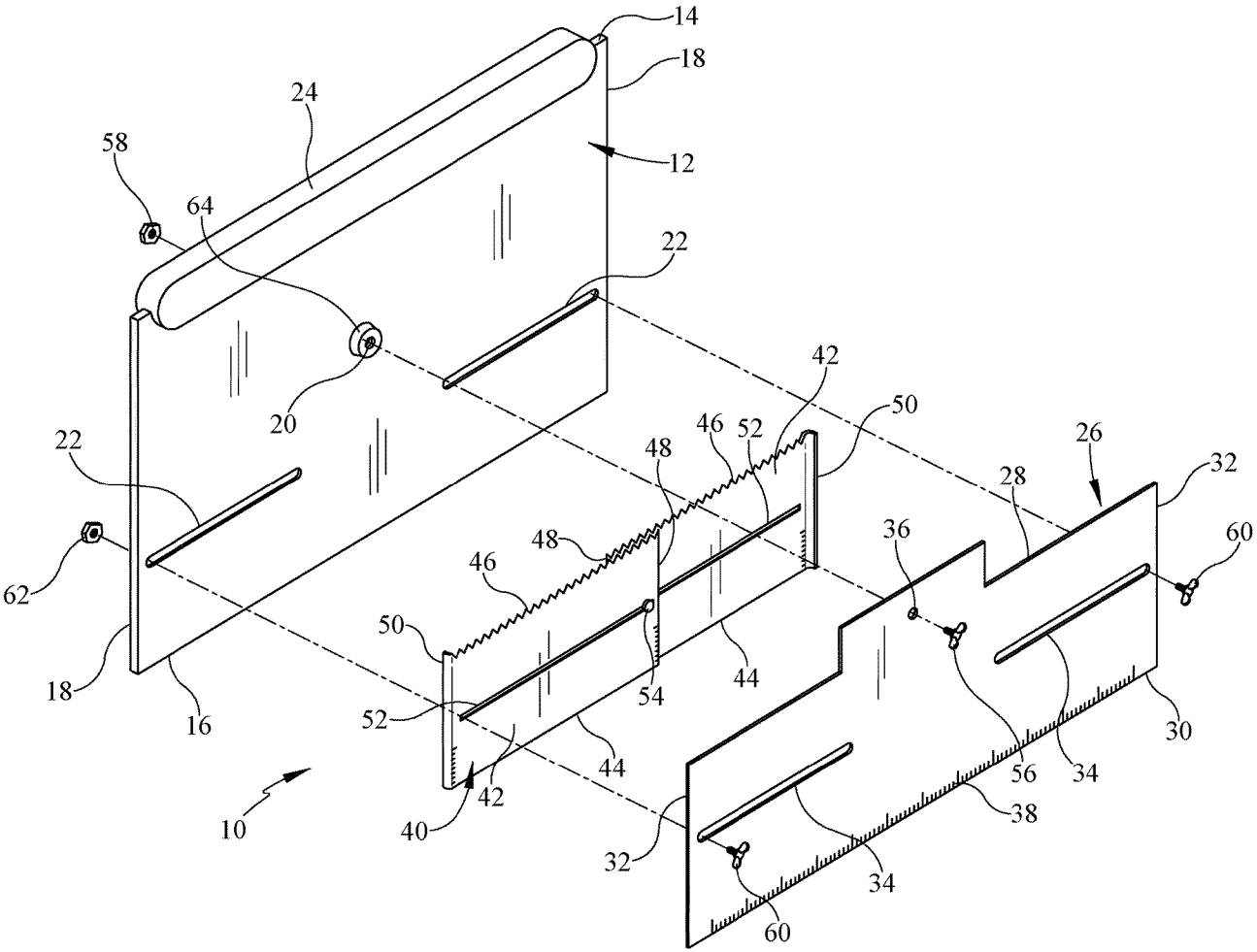
FIG. 2 is a partially exploded perspective view of the spreading tool having a variable width and variable depth blade for the configuration illustrated in FIG. 1.
Figure 3:
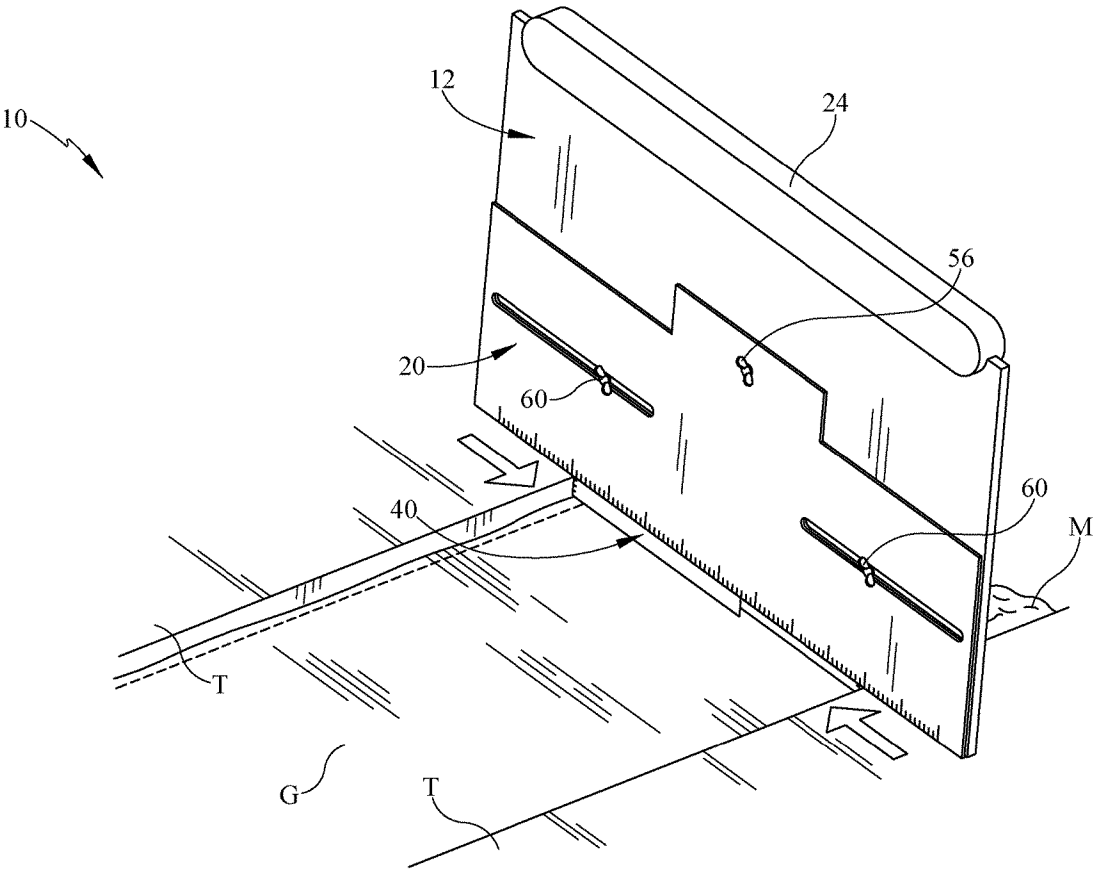
FIG. 3 is an environmental view of the spreading tool having a variable width and variable depth blade spreading an adhesive within a relatively narrow gap.
Figure 4:
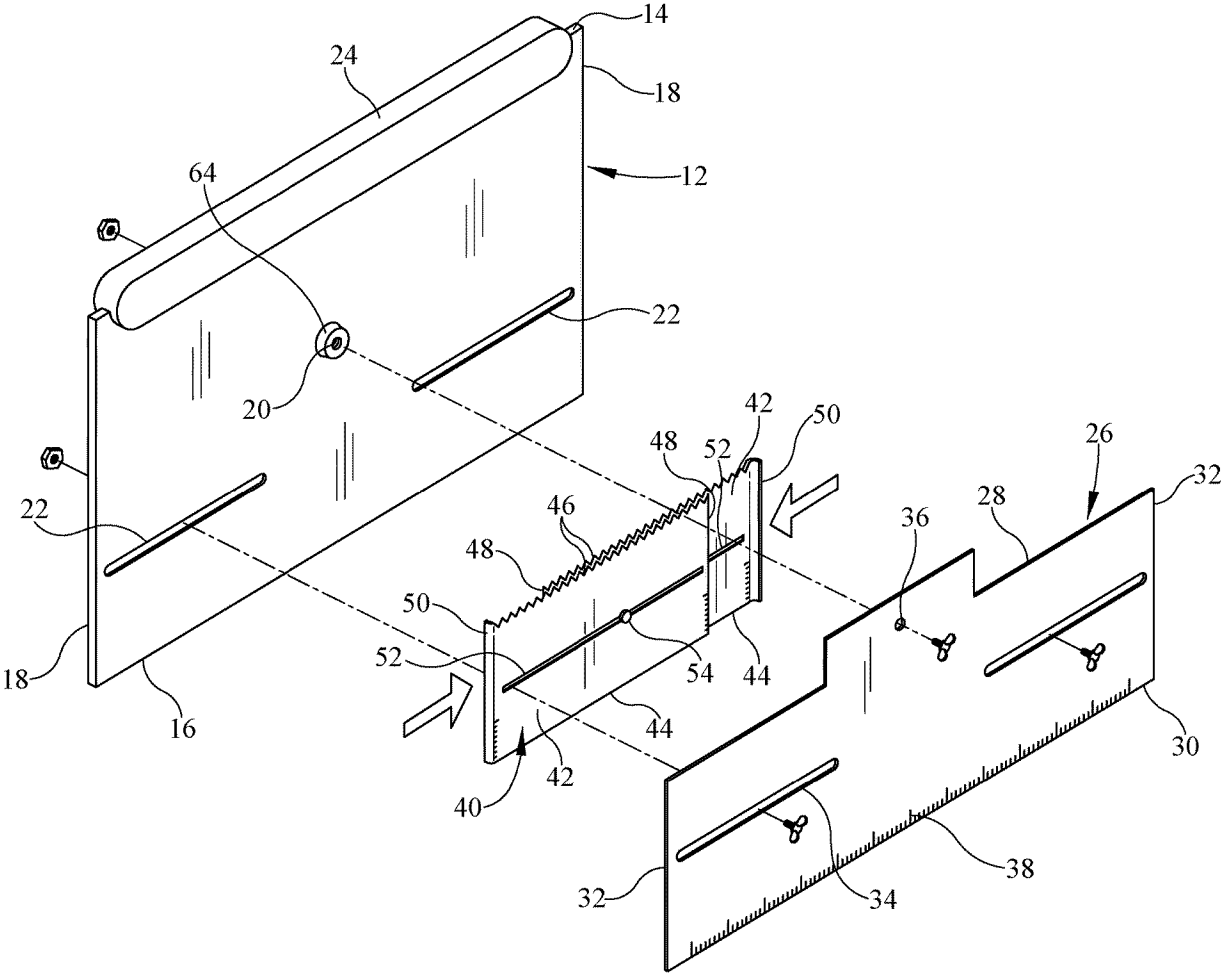
FIG. 4 is a partially exploded perspective view of the spreading tool having a variable width and variable depth blade for the configuration illustrated in FIG. 3.
Figure 5:
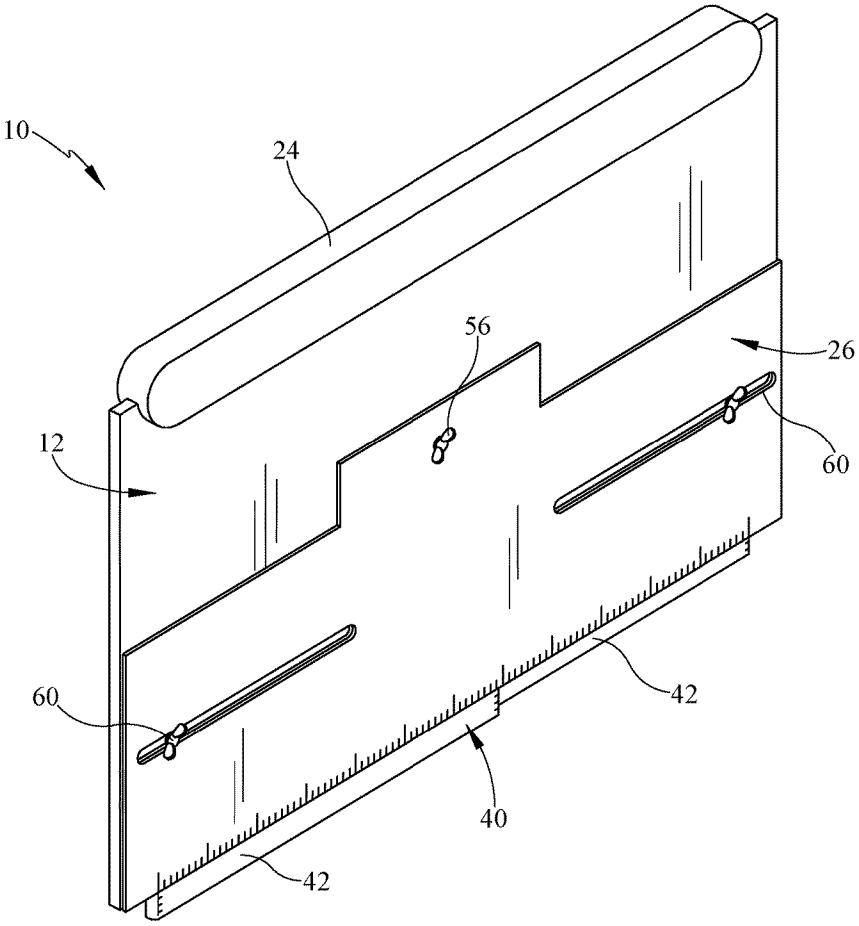
FIG. 5 is a perspective view of the spreading tool having a variable width and variable depth blade with a smooth edge of the blade deployed.
Figure 6:
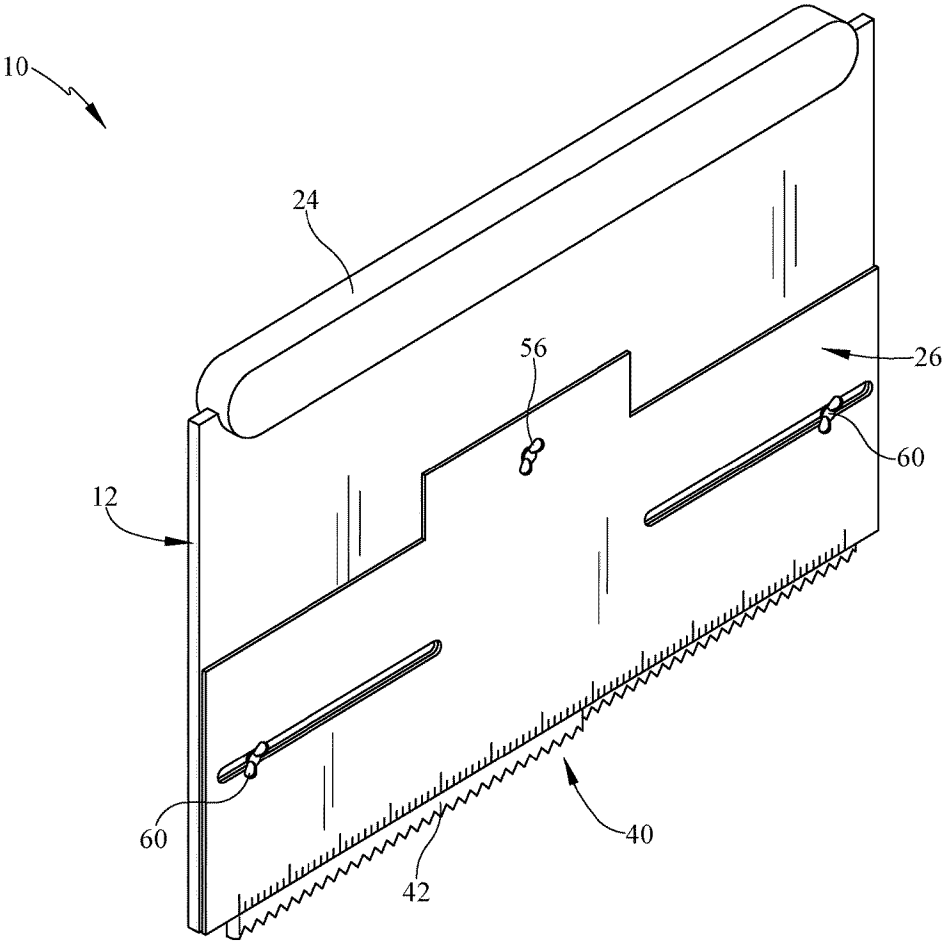
FIG. 6 is a perspective view of the spreading tool having a variable width and variable depth blade with a notched or serrated edge of the blade deployed.

Referring now to the drawings, it is seen that the spreading tool having a variable width and variable depth blade of the present invention, generally denoted by reference numeral 10, is comprised of a main plate 12 that has a first top edge 14 and a first bottom edge 16 joined by a pair of opposing first sides 18. A first opening 20 is located on the main plate 12. A pair of horizontally disposed first slots 22 is located on the main plate 12, each equidistant on either side of a vertical midline of the main plate 12 that extends between the first top edge 14 and the first bottom edge 16. The first slots 22 are each located the same distance above the first bottom edge 16. An appropriate handle 24 is attached to the first top edge 14 in appropriate fashion.

A press plate 26 has a second top edge 28 (which may have an upwardly protruding section, as illustrated) and a second bottom edge 30 joined by a pair of opposing second sides 32. A pair of horizontally disposed second slots 34 is located on the press plate 26, each equidistant on either side of a vertical midline of the press plate 26 that extends between second top edge 28 and the second bottom edge 30. The second slots 34 are each located the same distance above the second bottom edge 30, which distance may be equivalent to the distance between each first slot 22 and the first bottom edge 16. A second opening 36 is located on the press plate 26. A set of ruler markings 38 may be located along the second bottom edge 30.

A blade 40 is formed from a pair of blade plates 42. Each blade plate 42 has a first blade edge 44 and an opposing second blade edge 46. The first blade edge 44 may have a different blade surface relative to the second blade edge 46. By way of example in the illustrations seen, the first blade edge 44 has a smooth blade surface while the second blade edge 46 has a notched or serrated blade surface. Each blade plate 42 also has an inner side 48 and an outer side 50. Each blade plate 42 is a substantially flat plate member except for its outer side 50 which is curled outward. The depth of the curl of the outer side 50 is substantially equal to the thickness of blade plate 42. Each blade plate 42 has a horizontally disposed third slot 52. The blade plates 42 form the overall blade 40 by overlaying the two blade plates 42 atop one another so that when the blade plates 42 are overlaid, the inner side 48 of one of the blade plates 42 faces toward the outer side 50 of the other blade plate 42 and the blade edges 44 and 46 are located on the same axis in order to form one long overall blade edge. Additionally, the curling of the outer side 50 of one blade plate 42 faces in opposing directions to the other outer side 50 of the other blade plate 42. The two blade plates 42 are held together in overlapping relationship via a low profile rivet 54 or similar connector that passes through the third slot 52 of each blade plate 42 and is capable of traveling within each third slot 52. The edges of the third slots are slightly scalloped or otherwise depressed so that the rivet 54 does not rise above the outer surface of either blade plate 42. The rivet 54 permits one blade plate 42 to slide with respect to the other blade plate 42 so that the distance between the outer side 50 of each blade plate 42, and thus the overall width of the blade 40 is variable. As the depth of the curl of each outer side 50 is equivalent to the thickness of the blade plate 42, when the two blade plates 42 are so overlapped, the outer side 50 of one of the blade plates 42 is on the same plane as the surface of the other blade plate 42, the surface facing in opposing direction to the direction of its outer side 50.

The main plate 12, the press plate 26, and each blade plate 42 are each made from a strong sturdy material such as steel, aluminum, hard plastic and the like.

In order to use the spreading tool having a variable width and variable depth blade 10 of the present invention, the device is assembled by positioning the assembled blade 40 onto the main plate 12 so that the one of the blade edges 44 or 46 is slightly below the first bottom edge 16 of the main plate 12. Prior to such placement, the width of the blade 40 is adjusted as needed—to match the width of the gap G that exists between the first section of main tile T and second section of main tile T. Thereafter, the press plate 26 is positioned overtop main plate 12, ruler markings 38 facing out, in order to sandwich the blade 40 between the main plate 12 and the press plate 26. The main plate 12 and the press plate 26 are positioned such that the first bottom edge 16 of the main plate 12 aligns with the second bottom edge 30 of the press plate 26 and each first slot 22 of the main plate 12 aligns with a respective one of the second slots 34 of the press plate 26, although this is strictly not required so long as the working end—the overall blade edge of the blade 40 is below both the first bottom edge 16 of the main plate 12 and the second bottom edge 30 of the press plate 26. Each first side 18 of the main plate 12 may align with a respective one of the second sides 32 of the press plate 26. Additionally, the first opening 20 on the main plate 12 aligns with the second opening 36 on the press plate 26. The main plate 12 and the press plate 26 are held together by passing an appropriate connector, such as the illustrated first wing bolt 56 through aligned first opening 20 and second opening 36 and securing the first wing bolt 56 with an appropriate first nut 58. A second wing bolt 60 (or other desired connector) is passed through each of the aligned first slot 22-second slot 34 pairs and secured via second a nut 62. The blade 40 is positioned so that it is disposed a desired depth below the lower of the first bottom edge 16 of the main plate 12 and the second bottom edge 30 of the press plate 26. Once the desired depth is achieved, each second wing bolts 60 is slid within its first slot 22-second slot 34 pair until the second wing bolt 60 abuts against the curled outer side 50 of one of the blade plates 42. Thereafter both the first wing bolt 56 and the second wing bolts 60 are tightened sufficiently so as to firmly hold the blade 40 within its sandwiched position between the main plate 12 and the press plate 26. Either the first opening 20 (or the second opening 36) may have a raised portion 64 so that the top area of the press plate 26 is not bent too much when tightening the first wing bolt 56. Of course additional first opening 20-second opening 36 pairs may be provided with each receiving a first wing bolt 56 and first nut 58.

The user grasps the spreading tool having a variable width and variable depth blade 10 via the handle 24 and spreaders the adhesive M through the gap G between the first section of main tile T and the second section of main tile T. As seen, the two sections of first bottom edge 16 and the second bottom edge 30 (or the lower most disposed bottom edge) that are located outside the area from whereat the blade 40 extends, rest on one of the sections of main tile T allowing the user to precisely control the depth of blade 40 deployment and thus the thickness of the adhesive laid.

If the user needs to change either the depth of deployment of the blade 40 or the width of the blade 40 or both, then the two second wing bolts 60 are loosened a sufficient amount, and if need be, the first wing bolt(s) 56 are also loosened, the blade 40 is slid either up or down between the main plate 12 and the press plate 26, for depth adjustment, and/or the outer sides 50 of the blade plates 42 are moved either toward or away from one another, for width adjustment. If a width adjustment is performed, then each second wing bolt 60 is slid so as to abut against its respective blade plate 42 in order to hold the blade 40 at the selected width. Thereafter, each second wing bolt 60 is tightened and, if needed, each first wing bolt 56 is tightened and the job is resumed.

For any width adjustment of the blade 40, the ruler markings 38 on the press plate 26 help make precise adjustments. Although the ruler markings can be located on the main plate 12, the spreading tool having a variable width and variable depth blade 10 performs optimally whenever the main plate 12 is used to spread the adhesive M so that placement of the ruler markings onto the main plate 12 would cause the ruler markings to become fouled more quickly than when placed on the trailing edge of the press plate 26.

If the user needs to switch blade edges, then the second wing bolts 60 and possibly the first wing bolts 56 are loosened, the blade 40 is flipped so that the other blade edge protrudes from below the first bottom edge 16 and second bottom edge 30 and the second wing bolts 60 and first wing bolts 56 are once again tightened in order to securely sandwich the blade 40 between the main plate 12 and the press plate 26.

While the invention has been particularly shown and described with reference to an embodiment thereof, it will be appreciated by those skilled in the art that various changes in form and detail may be made without departing from the spirit and scope of the invention.

I claim:

1. A spreading tool comprising:

a main plate having a first bottom edge, a top edge, and a first pair of slots that are each parallel with the first bottom edge;

a press plate having a second bottom edge and a second pair of slots that are each parallel with the second bottom edge; and a blade that has a first side edge, a second side edge, and an overall blade edge that has a length that is variable, such that the blade is placed onto the main plate and the press plate is disposed on the blade so that the blade is sandwiched between the main plate and the press plate and such that the overall blade edge is disposed below the first bottom edge and the blade is also disposed below the second bottom edge and such that each of the first slots is aligned with a respective one of the second slots and a first connector passes through one of the aligned first slot second slot pairs and a second connector passes through the other aligned first slot second slot pairs when the press plate is secured to the main plate in order to hold the blade sandwiched therebetween and in a fixed relation with the main plate and the press plate.

2. The spreading tool as in claim 1 wherein the blade is comprised of a first blade plate having a first blade edge and a first outer side and a second blade plate having a second blade edge and a second outer side such that the first plate and the second plate are disposed in overlapping position with one another such that the first blade edge and the second blade edge align on an axis in order to form the overall blade edge and such that the first blade plate and second blade slide with respect to each other in order to vary a distance between the first outer side and the second outer side and thereby vary the length of the overall blade edge, the first outer side forming the first side edge and the second outer side forming the second side edge.

3. The spreading tool as in claim 2 wherein the first blade plate has a third slot and the second blade plate has a fourth slot such that the third slot and the fourth slot partially overlap and a third connector slidably disposed with the third slot and the fourth slot and is capable of sliding within the third slot and the fourth slot.

4. The spreading tool as in claim 1 further comprising ruler markings located along the second bottom edge.

5. The spreading tool as in claim 1 further comprising a handle attached to the top edge.

6. The spreading tool as in claim 1 further comprising a third connector that connects the main plate and the press plate without passing through the blade.

* * * * *